US010631105B2

(12) United States Patent
Nielsen

(10) Patent No.: US 10,631,105 B2
(45) Date of Patent: Apr. 21, 2020

(54) HEARING AID SYSTEM AND A METHOD OF OPERATING A HEARING AID SYSTEM

(71) Applicant: Widex A/S, Lynge (DK)

(72) Inventor: Jakob Nielsen, Copenhagen (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 15/938,508

(22) Filed: Mar. 28, 2018

(65) Prior Publication Data

US 2018/0220243 A1 Aug. 2, 2018

Related U.S. Application Data

(63) Continuation-in-part of application No. PCT/EP2015/072919, filed on Oct. 5, 2015.

(51) Int. Cl.
*H04R 25/00* (2006.01)
*G10L 21/02* (2013.01)

(52) U.S. Cl.
CPC ..... *H04R 25/505* (2013.01); *G10L 21/02* (2013.01); *H04R 25/50* (2013.01); *H04R 25/552* (2013.01); *H04R 2225/41* (2013.01); *H04R 2460/03* (2013.01)

(58) Field of Classification Search
CPC ..... H04R 25/505; H04R 25/50; G10L 21/02
USPC ..... 381/314–316
See application file for complete search history.

(56) References Cited

U.S. PATENT DOCUMENTS

| | | | | |
|---|---|---|---|---|
| 6,236,731 | B1 * | 5/2001 | Brennan | H03H 17/0266 381/312 |
| 2008/0212810 | A1 * | 9/2008 | Pedersen | H04R 25/407 381/312 |
| 2013/0070928 | A1 * | 3/2013 | Ellis | H04R 25/30 381/56 |
| 2013/0144615 | A1 * | 6/2013 | Rauhala | G10L 25/69 704/225 |
| 2014/0195028 | A1 * | 7/2014 | Emerson | G10L 19/018 700/94 |

FOREIGN PATENT DOCUMENTS

| | | | | |
|---|---|---|---|---|
| CN | 101593522 | A * | 12/2009 | |
| EP | 2 884 766 | A1 | 6/2015 | |
| EP | 2884766 | B1 * | 2/2018 | |
| WO | 01/76321 | A1 | 10/2001 | |
| WO | 2014/160678 | A2 | 10/2014 | |
| WO | WO-2014160678 | A2 * | 10/2014 | G10L 25/81 |

OTHER PUBLICATIONS

Lie Lu et al., "Content-based audio classification and segmentation by using support vector machines", Multimedia Systems, XP003006384, Jan. 1, 2003, pp. 482-491, vol. 8.
International Search Report for PCT/EP2015/072919 dated Mar. 4, 2016 [PCT/ISA/210].
Written Opinion for PCT/EP2015/072919 dated Mar. 4, 2016 [PCT/ISA/237].

* cited by examiner

*Primary Examiner* — Fan S Tsang
*Assistant Examiner* — Julie X Dang
(74) *Attorney, Agent, or Firm* — Sughrue Mion, PLLC

(57) ABSTRACT

A method of operating a hearing aid system (100) based on a classification of the current sound environment and a hearing aid system (100) for carrying out the method.

22 Claims, 2 Drawing Sheets

HEARING AID SYSTEM AND A METHOD OF OPERATING A HEARING AID SYSTEM

This application is a Continuation-in-part (CIP) of Application No. PCT/EP2015/072919 filed Oct. 5, 2015, the disclosure of which is incorporated by reference herein.

The present invention relates to hearing aid systems. The present invention also relates to a method of operating a hearing aid system and a computer-readable storage medium having computer-executable instructions, which when executed carries out the method.

BACKGROUND OF THE INVENTION

Generally a hearing aid system according to the invention is understood as meaning any system which provides an output signal that can be perceived as an acoustic signal by a user or contributes to providing such an output signal, and which has means which are used to compensate for an individual hearing loss of the user or contribute to compensating for the hearing loss of the user or contribute to compensating for the hearing loss. These systems may comprise hearing aids which can be worn on the body or on the head, in particular on or in the ear, and can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context a hearing aid may be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear. For this type of traditional hearing aids the mechanical design has developed into a number of general categories. As the name suggests, Behind-The-Ear (BTE) hearing aids are worn behind the ear. To be more precise, an electronics unit comprising a housing containing the major electronics parts thereof is worn behind the ear and an earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids. In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with other devices of the hearing aid system, or the external device alone may function as a hearing aid system. Thus within the present context the term "hearing aid system device" may denote a traditional hearing aid or an external device.

It is well known within the art of hearing aid systems that the optimum setting of the hearing aid system parameters may depend critically on the given sound environment. It has therefore been suggested to provide the hearing aid system with a multitude of complete hearing aid system settings, often denoted hearing aid system programs, which the hearing aid system user can choose among, and it has even be suggested to configure the hearing aid system such that the appropriate hearing aid system program is selected automatically without the user having to interfere. One example of such a system can be found in U.S. Pat. No. 4,947,432.

This general concept of automatically selecting the appropriate hearing aid system program requires that any given sound environment can be identified as belonging to one of several predefined sound environment classes. Methods and systems for carrying out this sound classification are well known within the art. However, these methods and systems may be quite complex and require significant processing resources, which especially for hearing aid systems may be a problem. On the other hand it may be an even worse problem if the sound classification method or system is not precise and reliable and therefore prone to misclassifications, which may result in deteriorated sound quality and speech intelligibility or degenerated comfort for the hearing aid system user.

It is therefore a feature of the present invention to provide a method of operating a hearing aid system that provides precise and robust sound classification using a minimum of processing resources.

It is another feature of the present invention to provide a hearing aid system adapted to provide precise and robust sound classification using a minimum of processing resources.

SUMMARY OF THE INVENTION

The invention, in a first aspect, provides a method of operating a hearing aid system comprising the steps of: providing an electrical input signal representing an acoustical signal from an input transducer of the hearing aid system; providing a feature vector comprising vector elements that represent features extracted from the electrical input signal; providing a first multitude of sound environment base classes, wherein none of the sound environment base classes are defined by the presence of speech; processing a second multitude of feature vectors in order to determine the probability that a given sound environment base class, from said first multitude of sound environment base classes, is present in an ambient sound environment; selecting a current sound environment base class by determining the sound environment base class that provides the highest probability of being present in the ambient sound environment; determining a final sound environment class based on said selected current sound environment base class and a detection of whether speech is present in the ambient sound environment; setting at least one hearing aid system parameter in response to said determined final sound environment class; and processing the electrical input signal in accordance with said setting of said at least one hearing aid system parameter, hereby providing an output signal adapted for driving an output transducer of the hearing aid system.

The invention, in a second aspect, provides a non-transient computer-readable storage medium having computer-executable instructions, which when executed carry put the above method.

The invention, in a third aspect, provides a hearing aid system comprising a hearing aid processor adapted for processing an input signal in order to relieve a hearing deficit of an individual user, and a sound environment classifier (104), wherein the sound environment classifier further comprises a feature extractor, a base class classifier and a final class classifier, wherein the hearing aid processor or the sound environment classifier comprises a speech detector that is configured to provide information to the final class classifier whether speech is present or not in the sound environment.

Further advantageous features appear from the appended claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects, all without departing from the invention. Accordingly, the drawings and descriptions will be regarded as illustrative in nature and not as restrictive. In the drawings.

DETAILED DESCRIPTION

Figure 1:
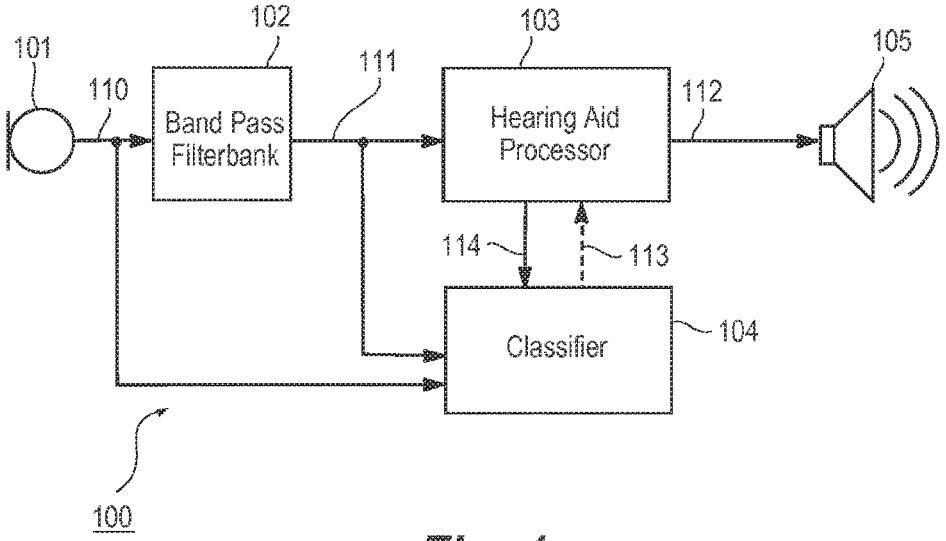
FIG. 1 illustrates highly schematically a hearing aid system according to a first embodiment of the invention.

Reference is first made to FIG. 1, which illustrates highly schematically a hearing aid system 100 according to a first embodiment of the invention. The hearing aid system comprises an acoustical-electrical input transducer 101, such as a microphone, a band-pass filter bank 102 that may also simply be denoted filter bank, a hearing aid processor 103, an electrical-acoustical output transducer 105, i.e. a loudspeaker that may also be denoted a receiver, and a sound environment classifier 104 that in the following may also simply be denoted: classifier. The input transducer 101 provides an input signal 110 that is branched and hereby provided to both the sound classifier 104 and to the band-pass filter bank 102 wherein the input signal 110 is divided into a multitude of frequency band signals 111 that in the following may also simply be denoted: input frequency bands or frequency bands. For clarity reasons the Analog-Digital Converter (ADC) processing block, that transforms the analog input signal into the digital domain as input signal 110, is not included in FIG. 1. In the following the input signal 110 may also be denoted the broadband input signal 110 in order to more clearly distinguish it from the input frequency band signals 111. The input frequency bands 111 are branched and directed to both the hearing aid processor 103 and the classifier 104. The hearing aid processor 103 processes the input frequency band signals 111 in order to relieve a hearing deficit of an individual user and provides an output signal 112 to the output transducer 105. The processing applied to the input frequency bands 111 in order to provide the output signal 112 depends at least partly on parameters controlled from the classifier 104 as depicted by the control signal 113, wherein the values of these parameters are determined as a function of the sound environment classification carried out by the classifier 104. According to the first embodiment the various values of the parameters, that are controlled from the classifier 104, are stored in connection with the hearing aid processor 103 such that the control signal 113 only carries the result of the sound environment classification from the final class classifier 205.

However, the hearing aid processor 103 also provides various features to the classifier 104 via the classifier input signal 114. The sound environment classification may therefore be carried out based on the input frequency band signals 111, the classifier input signal 114 and the broadband input signal 110.

Figure 2:
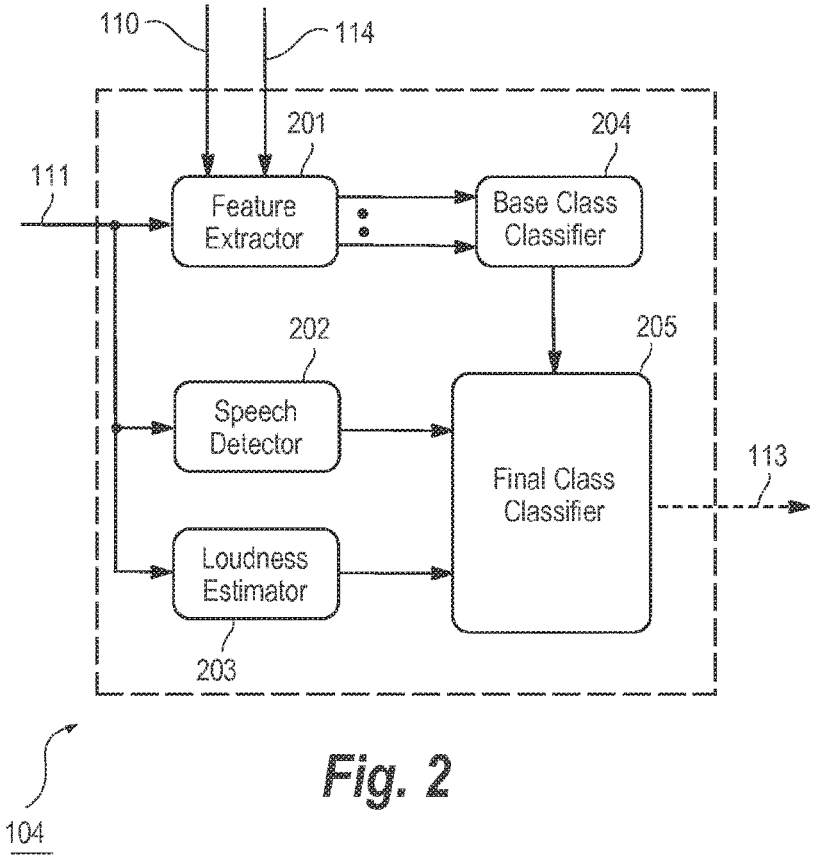
FIG. 2 illustrates highly schematically a classifier of a hearing aid system according to an embodiment of the invention.

Reference is now made to FIG. 2, which illustrates highly schematically additional details of the classifier 104 according to the first embodiment of the invention. The classifier 104 comprises a feature extractor 201, a speech detector 202, a loudness estimator 203, a base class classifier 204 and a final class classifier 205.

The feature extractor 201 provides as output a multitude of extracted features that may either be derived from the broadband input signal 110, from the input frequency band signals 111 or from the hearing aid processor 103 via the classifier input signal 114.

According to the first embodiment of the invention the broadband input signal 110 is passed through the band-pass filter bank 102, whereby the input signal 110 is transformed into fifteen frequency bands 111 with center frequencies that are non-linearly spaced by setting the center frequency spacing to a fraction of an octave, wherein the fraction may be in the range between 0.1 and 0.5 or in the range between 0.25 and 0.35. One advantage of having this particular frequency band distribution is that it allows features that reflect important characteristics of the human auditory system to be extracted in a relatively simple and therefore processing efficient manner.

However in variations of the first embodiment the band-pass filter bank may provide more or fewer frequency bands and the frequency band center frequencies need not be non-linearly spaced, and in case the frequency band center frequencies are non-linearly spaced they need not be spaced by a fraction of an octave.

According to the first embodiment of the invention the extracted features from the feature extractor 201 comprises a variant of Mel Frequency Cepstral Coefficients, a variant of Modulation Cepstrum coefficients, a measure of the amplitude modulation, a measure of envelope modulation and a measure of tonality.

The variant of the Mel Frequency Cepstral Coefficients $X_k$, according to the present embodiment, is given as a scalar product of a first and a second vector, wherein the first vector comprises N elements $x_n$, each holding an estimate of the absolute signal level, given in Decibel, of the signal output from a frequency band n provided by the filter bank 102 and wherein the second vector comprises N pre-determined values $h_{n,k}$ given by the formula:

$$h_{n,k} = \cos\left[\frac{\pi}{N}\left(n + \frac{1}{2}\right)k\right],$$

wherein the index n represents a specific one of the input frequency bands 111, and wherein the scalar product is determined as a function of a selected specific value of k, such that the value of the k'th coefficient $X_k$ is given by the Direct Cosine Transform (DCT):

$$X_k = \sum_{n}^{N-1} x_n \cos\left[\frac{\pi}{N}\left(n + \frac{1}{2}\right)k\right], \quad k = 0, \ldots, N-1$$

This DCT is commonly known as DCT-II and in variations of the present embodiment other versions of a DCT may be applied.

These variants of the Mel Frequency Cepstral Coefficients are advantageous over the original Mel Frequency Cepstral Coefficients (MFCCs) with respect to the required processing resources in a hearing aid system.

Although original MFCCs may be found in slightly varying versions, all variants share some basic characteristics including the steps of:

1) taking the Fourier transform of a signal,
2) mapping the power levels of the spectrum obtained above onto the Mel scale, using triangular overlapping windows,
3) taking a logarithm of the power levels at each of the Mel frequencies, hereby providing a multitude of Mel logarithmic power levels,
4) applying a direct cosine transform to said multitude of Mel logarithmic power levels, hereby providing a resulting spectrum, and
5) determining the MFCCs as the amplitudes of the resulting spectrum Considering the differences between the variant of the MFCCs, according to the present embodiment, and the original MFCCs it follows that the steps 1)-3) described above may be omitted and instead replaced by the steps of applying the estimate of the absolute signal levels, given in Decibel, of the signal output from the frequency bands, which are determined anyway for other purposes by the hearing aid processor 103 and which therefore may be achieved directly from the hearing aid processor 103 using only a minimum of processing resources as opposed to having to carry out a Fourier transform, mapping the resulting spectrum onto the Mel scale and taking the logarithm of the power levels at each of the Mel frequencies.

In obvious variations of the first embodiment the estimate of the absolute signal level need not be given in Decibel. As one alternative other logarithmic forms may be used.

According to the first embodiment only the $2^{nd}$ to $7^{th}$ cepstral coefficients are extracted by the feature extractor 201. However, in variations of the first embodiment more or fewer cepstral coefficients may be extracted and in further variations all frequency bands need not be used for determining the cepstral coefficients.

According to the first embodiment the estimate of the absolute signal level $x_n$ used for determining the variant of the MFCCs is determined in accordance with the formula:

$$x_n(s) = x_n(s-1)(1-\alpha) + |y_n(s)|\alpha$$

wherein the index n represents a specific one of the input frequency bands 111, wherein s represents a discrete time step determined by a sample rate, wherein $y_n(s)$ represents samples of the absolute signal level, wherein $\alpha$ is a constant in the range between 0.01 and 0.0001 or between 0.005 and 0.0005, and wherein the sample rate is 32 kHz or in the range between 30 and 35 kHz. Obviously, the selected values of the sample rate and the constant $\alpha$ depend on each other in order to provide the estimate of the absolute signal level with the desired characteristics. In variations $\alpha$ may depend on the specific frequency band, since the signal variations and hereby the requirements to the absolute signal level estimate depends on the frequency range.

However, in variations other estimates of the absolute signal level may be used, e.g. the 90% percentile or a percentile signal in the range between 80% and 98%.

The variant of the modulation cepstrum coefficients is, as is the case for the cepstral coefficients, determined based on the input frequency bands 111 provided by the band-pass filter bank 102, and the final step of determining the modulation cepstrum coefficients is carried out by a calculating a simple scalar vector. In the following this variant of the modulation cepstrum coefficients may simply be denoted: modulation cepstrum coefficients. This variant of the modulation cepstrum coefficients is therefore advantageous for the same reasons as the cepstral coefficients according to the present embodiment.

More specifically the modulation cepstrum coefficients, according to the first embodiment of the invention, is determined by:

summing an estimate of the absolute signal levels of a first multitude of frequency bands in the low frequency range, e.g. the eight lowest input frequency bands, and of a second multitude of frequency bands in the high frequency range, e.g. the seven highest input frequency bands, and using the same estimate of the absolute signal level as disclosed above for the variant of the MFCCs, filtering the summed signals in respectively a low-pass, band-pass and high-pass filter covering the frequency ranges of 0-4 Hz, 4-16 Hz and 16-64 Hz, hereby providing a total of six filtered signals, determining the modulation of the six filtered signals by determining the difference between the 10% percentile and the 90% percentile of said six filtered signals, determining the cepstrum coefficients of the amplitude modulation of the six filtered signals in the same manner as described above with reference to the variant of the Mel frequency cepstrum coefficients in so far that the first vector comprising N elements $x_n$ each holding an estimate of the absolute signal level, given in Decibel, of the signal output from a frequency band n provided by the filter bank 102 is replaced by the determined modulation of the six filtered signals.

In variations of the first embodiment the feature representing the modulation cepstrum coefficients may be determined using other frequency ranges and/or more or less summed signals.

The feature representing the amplitude modulation may be determined in a variety of alternative ways all of which will be well known by a person skilled in the art and the same is true for the feature representing envelope modulation.

The feature extractor 201 also provides a feature representing tonality that may be described as a measure of the amount of non-modulated pure tones in the input signal. According to the embodiment of FIG. 1 this feature is obtained from a feedback cancellation system comprised in the hearing aid processor. The feature is determined by calculating the auto-correlation for a multitude of frequency bands. More specifically auto-correlation values for two adjacent frequency bands, covering a frequency range including 1 kHz, are summed and subsequently low pass filtered in order to provide the feature representing tonality. It is a specific advantage of the selected feature representing tonality that it is also applied by the feedback cancellation system and therefore is an inexpensive feature with respect to processing resources.

However, a feature representing tonality may be determined in a variety of alternative ways all of which will be well known by a person skilled in the art.

It is a specific advantage of the present classifier 104 that a significant part of the features used to classify the sound environment are at least partly based on features that are calculated or determined for other purposes in the hearing aid system, whereby the amount of additional processing resources required by the classifier can be kept small.

According to the first embodiment of the invention a total of twelve features are provided from the feature extractor 201 and to the base class classifier 204 in the form of a feature vector with twelve individual elements each representing one of said twelve features. According to variations of the first embodiment of the invention fewer or more features may be included in the feature vector.

The base class classifier 204 comprises a class library, that may also be denoted a codebook. The codebook consists of a multitude of pre-determined feature vectors, wherein each of the pre-determined feature vectors are represented by a symbol. Additionally the base class classifier comprises pre-determined probabilities that a given symbol belongs to a given sound environment base class.

The pre-determined feature vectors and pre-determined probabilities that a given symbol belongs to a given sound environment base class are derived from a large number of real life recordings (i.e. training data) spanning the sound environment base classes. According to the present embodiment the base class classifier 204 is configured to have four sound environment base classes: urban noise, transportation noise, party noise and music, wherefrom it follows that none of the sound environment base classes are defined by the presence of speech.

Whenever a current feature vector is provided to the base class classifier 204, then the current feature vector is compared to each of the pre-determined feature vectors by using a minimum distance calculation to estimate the similarity between each of the pre-determined feature vectors and the current feature vector, whereby a symbol is assigned to each sample of the current feature vector, by determining the pre-determined feature vector that has the shortest distance to the current feature vector.

According to the present embodiment the codebook comprises 20 pre-determined feature vectors and accordingly there are 20 symbols.

According to the present embodiment the L1 norm also known as the city block distance is used to estimate the similarity between each of the pre-determined feature vectors and the current feature vector due to its relaxed requirements to processing power relative to other methods for minimum distance calculation such as the Euclidian distance also known as the L2 norm.

According to a variation of the present embodiment the training data are analyzed and the sample variance for each of the individual elements in the feature vector determined. Based on this sample variance the individual elements of a current feature vector are weighted such that the expected sample variance for each of the individual elements is below a predetermined threshold or within a certain range such as between 0.1 and 2.0 or between 0.5 and 1.5. However, since a weighting of data is involved the numerical value of the predetermined threshold can basically be anything. Obviously, the pre-determined feature vectors are weighted accordingly.

Hereby, it is avoided that a single element of the feature vector has a too high impact on the resulting distance to a pre-determined feature vector and furthermore the dynamic range required for the feature vector may be reduced, whereby the memory and processing requirements to the hearing aid system may likewise be reduced.

According to another variation of the present embodiment the training data are analyzed and the sample mean for each of the individual elements in the feature vector determined. Based on this sample mean the individual elements of a current feature vector are normalized, by subtracting the sample mean as a bias. In variations another bias may be subtracted, such that the expected sample mean for each of the individual elements is below a predetermined threshold of 0.1 or 0.5. However, since a weighting of data is involved the numerical value of the predetermined threshold may basically be anything. Obviously, the pre-determined feature vectors are normalized accordingly. Hereby, the dynamic range required for the feature vector may be reduced, whereby the memory and processing requirements to the hearing aid system may likewise be reduced.

It is a further advantage of the disclosed variations directed at weighting and normalizing the feature vector elements that the subsequent processing of the feature vector is simplified.

The 32 most recent identified symbols is stored in a circular buffer and by combining the stored identified symbols with the corresponding pre-determined probabilities that a given symbol belongs to a given sound environment base class, then a running probability estimate that a given sound environment base class is present in the ambient sound environment can be derived. The base class with the highest running probability estimate is selected as the current sound environment base class and provided to the final class classifier 205. According to the present embodiment the running probability estimate is derived by adding the 32 pre-determined probabilities corresponding to the 32 most recently identified symbols, wherein the pre-determined probabilities are calculated by taking a logarithm to the initially determined probabilities, which makes it possible to save processing resources because the pre-determined probabilities may be added instead of multiplied in order to provide the running probability estimate.

In variations fewer or more symbols may be stored, e.g. in the range between 15 and 50 or in the range between 30 and 35. By storing 32 symbols representing a time window of one second or in the range between a half and five seconds then an optimum compromise between complexity and classification precision is achieved.

According to another variation of the first embodiment of the invention an initial multitude of base classes and the corresponding running probability estimates are mapped onto a second smaller multitude of base classes. This allows a more flexible and precise sound environment classification because sound environments such as transportation noise may exhibit characteristics that are highly variable, e.g. dependent on whether a car window is open or closed. According to more specific variations the initial multitude of sound environment base classes comprises in the range between seven and fifteen base classes and the second smaller multitude comprises in the range between four and six sound environment base classes.

According to still other variations of the first embodiment of the invention the current base class that is provided to the final class classifier 205 is determined after low-pass filtering of the running probability estimates for each of the sound environment base classes. In variations other averaging techniques may be applied in order to further smooth the running probability estimates, despite that the implementation according to the first embodiment provides a smoothed output by summing the 32 pre-determined probabilities.

In addition to the current base class the final class classifier 205 also receives input from a speech detector 202 and a loudness estimator 203 and based on these three inputs the final sound environment classification is carried out.

The loudness estimator 203 provides an estimate that is either high or low to the final class classifier 205. The estimation includes: a weighting of the estimated absolute signal levels of the frequency band signals 111 in order to mimic the equal loudness contours of the auditory system for a normal hearing person, a summation of the weighted frequency band signal levels and a comparison of the summed levels with a predetermined threshold in order to estimate whether the loudness estimate is high or low. According to an advantageous variation the predetermined threshold is split into two predetermined thresholds in order to introduce hysteresis in the loudness estimation.

According to yet another variation the loudness estimation is determined by weighting the 10% percentile of the frequency band signals with the band importance function of a Speech Intelligibility Index (see e.g. the ANSI S3.5-1969 standard (revised 1997)) and selecting the largest weighted 10% percentile of the frequency band signals as the loudness level, that is subsequently compared with pre-determined thresholds in order to estimate the loudness as either high or low. It is a specific advantage of this variation that the largest level of the weighted 10% percentiles of the frequency bands is also used by the hearing aid system in order to determine an appropriate output level for sound messages generated internally by the hearing aid system.

It is a specific advantage of the present classifier 104 that the loudness estimation is carried out separately because this has made it possible to only apply features for the feature vector that are independent on the sound pressure level, whereby a more precise sound classification can be obtained.

The speech detector 202 provides an estimate of whether speech is present or not for the final class classifier 205. The speech detector may be implemented as disclosed in WO-A1-2012076045, especially with respect to FIG. 1 and the corresponding description. Nevertheless, speech detection is a well-known concept within the art of hearing aids, and in variations of the present embodiment other methods for speech detection may therefore be applied, all of which will be obvious for a person skilled in the art.

It is a specific advantage of the present classifier 104 that the speech detection is carried out separately because this allows the use of advanced methods of speech detection that operate independently of the remaining sound classification features, such as the feature extractor 201 and the base class classifier 204 according to the present embodiment. Hereby a more robust and precise sound classification can be obtained, because the sound environments representing the base classes are more distinctly different. Additionally the sound classification may require fewer processing resources because the feature vectors can be selected without having to include features directed at detecting speech. Yet another advantage according to the present embodiment is that the separate speech detection is carried out anyway by the hearing aid system and therefore requires basically no extra resources when being used by the classifier 104.

For reasons of clarity the speech detector 202 is illustrated in FIG. 2 as being part of the classifier 104. In an alternative and more advantageous implementation the speech detector is part of the hearing aid processor 103 and the result of the speech detection is provided to both the final class classifier 205 and to other processing blocks in the hearing aid systems, e.g. a speech enhancement block controlling the gain to be applied by the hearing aid system such as it is disclosed in WO-A1-2012076045 especially with respect to FIG. 2 and the corresponding description.

According to the first embodiment of the present invention, the final class classifier 205 maps the current base class onto one of the final sound environment classes based on the additional input from the speech detector 202 and the loudness estimator 203, wherein the final sound environment classes represent the sound environments: quiet, urban noise, transportation noise, party noise, music, quiet speech, urban noise and speech, transportation noise and speech, and party noise and speech.

The mapping is carried out by first considering the loudness estimate, and in case it is low, the final sound environment class is quiet or quiet speech dependent on the input from the speech detector. If the loudness estimate is high then the final sound environment is selected as the current base class with or without speech again dependent on the input from the speech detector.

According to a variation of the first embodiment of the present invention, the input from the loudness estimator 203 and to the final class classifier 205 may be omitted and instead the loudness (i.e. the weighted sound pressure level) is included in the current feature vector, and in this case the sound environment base class will comprise the quiet sound environment.

According to yet another variation of the first embodiment of the present invention the final class classifier 205 additionally receives input from a wind noise detection block. If the wind noise detection block signals that the level of the wind noise exceeds a first predetermined threshold then the final sound environment class is frozen until wind noise again is below a second predetermined threshold. This prevents the classifier 104 from seeking to classify a sound environment that the classifier 104 is not trained to classify, and which sound environment is better handled by other processing blocks in the hearing aid system.

A first embodiment has been disclosed above along with a plurality of variations whereby multiple embodiments may be formed by including one or more of the disclosed variations in the first embodiment.

Figure 3:
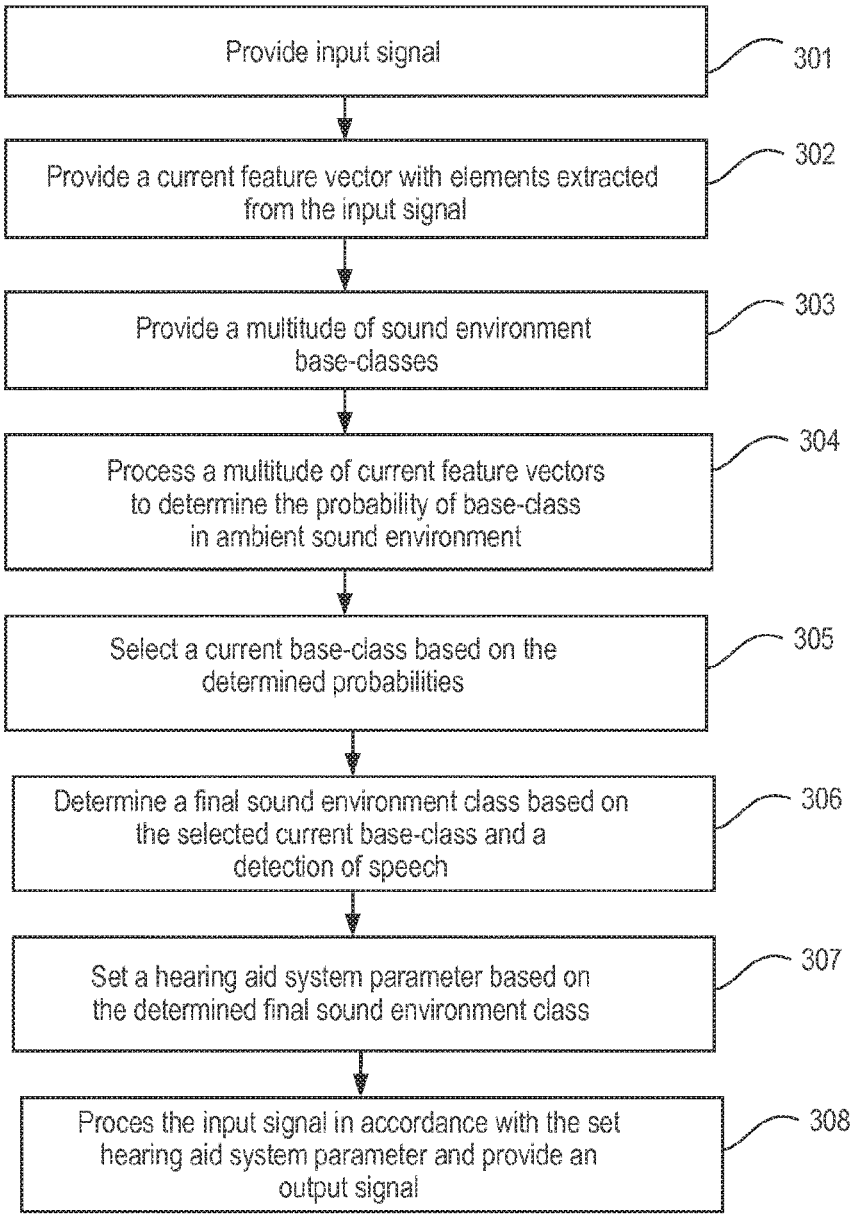
FIG. 3 illustrates highly schematically a method of operating a hearing aid system according to an embodiment of the invention.

Reference is now made to FIG. 3 which illustrates highly schematically a method of operating a hearing aid system according to an embodiment of the invention.

The method comprises:

a first step 301 of providing an electrical input signal representing an acoustical signal from an input transducer of the hearing aid system;

a second step 302 of providing a current feature vector comprising vector elements that represent features extracted from the electrical input signal;

a third step 303 of providing a first multitude of sound environment base classes, wherein none of the first predetermined sound environments are defined by the presence of speech;

a fourth step 304 of processing a second multitude of feature vectors in order to determine the probability that a given sound environment base class, from said first multitude of sound environment base classes, is present in an ambient sound environment;

a fifth step 305 of selecting a current sound environment base class by determining the sound environment base class that provides the highest probability of being present in the ambient sound environment;

a sixth step 306 of determining a final sound environment class based on said selected current sound environment base class and a detection of whether speech is present in the ambient sound environment;

a seventh step 307 of setting at least one hearing aid system parameter in response to said determined final sound environment class; and an eighth step 308 of processing the electrical input signal in accordance with said setting of said at least one hearing aid system parameter, hereby providing an output signal adapted for driving an output transducer of the hearing aid system.

The method embodiment of the invention may be varied by including one or more of the variations disclosed above with reference to the hearing aid system embodiment of the invention.

The invention claimed is:

1. A method of operating a hearing aid system comprising the steps of:

providing an electrical input signal representing an acoustical signal from an input transducer of the hearing aid system;

providing a feature vector comprising vector elements that represent features extracted from the electrical input signal;

providing a first multitude of sound environment base classes, wherein none of the sound environment base classes are defined by the presence of speech;

processing a second multitude of feature vectors in order to determine the probability that a given sound environment base class, from said first multitude of sound environment base classes, is present in an ambient sound environment;

selecting a current sound environment base class by determining the sound environment base class that provides the highest probability of being present in the ambient sound environment;

determining a final sound environment class based on said selected current sound environment base class and a detection of whether speech is present in the ambient sound environment;

setting at least one hearing aid system parameter in response to said determined final sound environment class; and processing the electrical input signal in accordance with said setting of said at least one hearing aid system parameter, hereby providing an output signal adapted for driving an output transducer of the hearing aid system.

2. The method according to claim 1, wherein the step of determining the final sound environment class includes the steps of:

estimating the loudness of the input signal; and determining the final sound environment class in dependence on the level of the estimated loudness.

3. The method according to claim 1, wherein the sound environment base classes are selected from a group comprising: urban noise, transportation noise, party noise, and music.

4. The method according to claim 1, wherein the sound environment base classes are defined such that the current sound environment base class can be determined independent on the sound pressure level of the current sound environment.

5. The method according to claim 1, wherein the final sound environment class is selected from a group comprising: quiet, urban noise, transportation noise, party noise, music, quiet speech, urban noise and speech, transportation noise and speech, and party noise and speech.

6. The method according to claim 1, wherein at least two of the features extracted from the electrical input signal are based on data provided by hearing aid system algorithms whose main function is not to provide classification.

7. The method according to claim 1, wherein one of the features extracted from the electrical input signal is a measure of the tonality and wherein the tonality measure is derived based on an auto-correlation that is determined by a feedback cancelling circuit of the hearing aid system.

8. The method according to claim 1, wherein said features extracted from the electrical input signal comprises at least one feature from a group comprising: a variant of a Mel Frequency Cepstral Coefficient, a variant of a Modulation Cepstrum, a measure of amplitude modulation, a measure of envelope modulation and a measure of tonality.

9. The method according to claim 1, wherein one of the features extracted from the electrical input signal is determined as a scalar product of a first and a second vector, wherein the first vector comprises N elements each holding an estimate of the absolute signal level of the signal output from a frequency band n provided by the filter bank 102, the second vector comprises N pre-determined values $h_{n,k}$ determined such that the scalar product provides a direct cosine transform of the elements of the first vector, and the indices n and k both represent frequency bands of the filter bank and wherein the scalar product is determined as a function of a selected specific value of k.

10. The method according to claim 1, wherein all the individual elements of a current feature vector, are individually weighted such that the expected sample variances for said individual elements, are below a predetermined threshold.

11. The method according to claim 1, wherein all the individual elements of a current feature vector are normalized, by subtracting a bias.

12. The method according to claim 1, wherein the step of processing a second multitude of feature vectors in order to determine the probability that a given sound environment base class, from said first multitude of sound environment base classes, is present in an ambient sound environment comprises the steps of:

providing a set of pre-determined feature vectors, wherein each of said pre-determined feature vectors is represented by a symbol;

identifying a symbol based on a determination of the pre-determined feature vector that has the smallest distance to the current feature vector; and combining a multitude of identified symbols with a corresponding pre-determined set of probabilities that a given symbol occurs in a given sound environment base class and hereby providing the probability that a given sound environment base class, from said first multitude of sound environment base classes, is present in an ambient sound environment.

13. The method according to claim 12, wherein the step of combining a multitude of identified symbols with a corresponding pre-determined set of probabilities that a given symbol occurs in a given sound environment base class comprises the step of:

adding the pre-determined set of probabilities corresponding to said multitude of identified symbols, in order to provide the probability that a given sound environment base class, from said first multitude of sound environment base classes, is present in the ambient sound environment, wherein the pre-determined probabilities are calculated by taking a logarithm to initially determined probabilities.

14. A non-transitory computer-readable storage medium having computer-executable instructions, which when executed carries out the method according to claim 1.

15. A hearing aid system comprising a hearing aid processor (103) adapted for processing an input signal in order to relieve a hearing deficit of an individual user, and a sound environment classifier (104)

wherein the sound environment classifier (104) further comprises a feature extractor (201), a base class classifier (204) and a final class classifier (205), wherein the hearing aid processor (103) or the sound environment classifier (104) comprises a speech detector (202) that is configured to provide information to the final class classifier (205) whether speech is present or not in the sound environment.

16. The hearing aid system according to claim 15 comprising a loudness estimator (203) that provides an estimate of the sound pressure level of the sound environment information to the final class classifier (205).

17. The hearing aid system according to claim 15 comprising a filter bank adapted for separating the input signal into a multitude of frequency band signals wherein the frequency band center frequencies are arranged to reflect the human auditory system's frequency dependent response more precisely than linearly spaced frequency bands.

18. The hearing aid system according to claim 15 wherein the feature extractor (201) is adapted to derive a feature representing a variant of a Mel Frequency Cepstral Coefficient by determining a scalar product of a first and a second vector, wherein the first vector comprises N elements each holding an estimate of the absolute signal level of the signal output from a frequency band n provided by the filter bank 102, the second vector comprises N pre-determined values $h_{n,k}$ determined such that the scalar product provides a direct cosine transform of the elements of the first vector, and the indices n and k both represent frequency bands of the filter bank and wherein the scalar product is determined as a function of a selected specific value of k.

19. The hearing aid system according to claim 18, wherein the N pre-determined values $h_n$ k are given by the formula:

$$h_{n,k} = \cos\left[\frac{\pi}{N}\left(n + \frac{1}{2}\right)k\right].$$

20. The hearing aid system according to claim 15 wherein the feature extractor (201) is adapted to derive a feature representing the tonality of the input signal by taking an average of the auto-correlation determined for at least two frequency band signals and wherein the auto-correlation is determined by a feedback cancelling circuit of the hearing aid system.

21. The hearing aid system according to claim 15, wherein base classifier provides a plurality of sound environment base classes that are not dependent on the presence of speech, said hearing aid system is configured to select one of those sound environment base classes as a current sound environment base class, and said final class classifier is configured to select a final sound environment class based on the current sound environment base class and said information provided by said speech detector.

22. The hearing aid system according to claim 15, wherein:

the feature extractor is configured to provide a feature vector comprising vector elements that represent features extracted from the electrical input signal;

the base classifier is configured to provide a first multitude of sound environment base classes, wherein none of the sound environment base classes are defined by the presence of speech;

process a second multitude of feature vectors in order to determine the probability that a given sound environment base class, from said first multitude of sound environment base classes, is present in an ambient sound environment; and select a current sound environment base class by determining the sound environment base class that provides the highest probability of being present in the ambient sound environment;

the final classifier is configured to determine a final sound environment class based on said selected current sound environment base class and a detection of whether speech is present in the ambient sound environment; and the hearing aid processor is configured to set at least one hearing aid system parameter in response to said determined final sound environment class, and to process the electrical input signal in accordance with said setting of said at least one hearing aid system parameter, thereby providing an output signal adapted for driving an output transducer of the hearing aid system.

* * * * *